United States Patent [19]

Feiler

[11] 4,049,266

[45] Sept. 20, 1977

[54] SPORT PRACTICE APPARATUS

[76] Inventor: Robert J. Feiler, 2 Oriole Place, Portchester, N.Y. 10573

[21] Appl. No.: 651,678

[22] Filed: Jan. 23, 1976

Related U.S. Application Data

[62] Division of Ser. No. 537,678, Dec. 30, 1974, Pat. No. 3,948,517.

[51] Int. Cl.[2] ..... A63B 61/00

[52] U.S. Cl. ..... 273/29 A; 273/26 E; 273/197 A

[58] Field of Search ..... 273/29 A, 26 E, 197 R, 273/197 A, 184 B, 185 C, 200 R, 200 A, 200 B, 95 A, 183 C, 186 B, 198, 196

[56] References Cited

U.S. PATENT DOCUMENTS

| | | | |
|---|---|---|---|
| 1,603,094 | 10/1926 | Owens | 273/197 A X |
| 2,247,072 | 6/1941 | Stow | 273/29 A |
| 2,305,187 | 12/1942 | Neiden | 273/29 A |
| 2,697,603 | 12/1954 | Haines | 273/95 AX |
| 2,851,272 | 9/1958 | Shatzer | 273/95 A |
| 2,929,632 | 3/1960 | Moffatt | 273/185 C |
| 3,231,271 | 1/1966 | Murphy | 273/29 A |
| 3,421,200 | 9/1967 | Brandley | 273/26 E |
| 3,503,611 | 3/1970 | McPherson | 273/29 A |
| 3,825,259 | 7/1974 | Burchett | 273/29 A |
| 3,948,517 | 4/1976 | Feiler | 273/29 A |

FOREIGN PATENT DOCUMENTS

| | | | |
|---|---|---|---|
| 489,842 | 8/1938 | United Kingdom | 273/29 A |

*Primary Examiner*—William H. Grieb

[57] ABSTRACT

An apparatus for practising stroking a ball with a racket as in the game of tennis which provides an indication of correct execution of a stroke comprising a racket target means and a rotating ball means. The rotating ball means is mounted for rotation in a vertical plane upon being struck. A path defining means is provided which arrests the rotation of the ball except when it has been hit correctly.

4 Claims, 10 Drawing Figures

SPORT PRACTICE APPARATUS

This is a division of application Ser. No. 537,678, filed Dec. 30, 1974, now U.S. Pat. No. 3,948,517, issued Apr. 6, 1976.

BACKGROUND OF THE INVENTION

1. Field of the Invention

The present invention relates generally to sports devices and more particularly to those used for developing skills in sports which involve stroking at a ball while it is in midair.

In particular, it relates to a device to combat the injury commonly described as "tennis elbow" by providing a simple and effective means for allowing a player to develop the forearm extensor muscles, to learn and practice the correct handling of the racket and to develop skills in correctly hitting a ball.

2. Description of the Prior Art

Various techniques have been suggested to aid tennis players in improving their stroke. These include specially designed rackets or attachments to rackets, various captive ball devices and combinations of these.

Exemplifying the first group, U.S. Pat. No. 3,503,611 discloses a practice tennis racket which includes a ball catching bag disposed on one side of the face of the racket instead of strings. When the ball hits the center of the racket, the ball is caught in the bag, thereby indicating that the user has properly hit the ball.

This apparatus has several limitations. The racket is useful only in practice since the strings are removed. Further, the bag and the cover disposed over it gives the racket characteristics differing from an actual racket, specially as to weight and wind resistance.

Captive ball practicing devices are disclosed in U.S. Pat. Nos. 2,247,072 and 3,825,259 which teach a ball positioned on an elastic cord which is secured at both ends to appropriate mounting means. The ball is usually moveable along the length of the cord to allow positioning at various heights from the ground. When struck with a tennis racket the ball will move away from the racket to the full extension of the restraining cord, return and continue oscillating at decreasing amplitude until it returns to its original stationary position. U.S. Pat. No. 2,247,072 provides for a dampening mechanism which more rapidly decreases the oscillations.

In the captive ball type of practice device utilizing an elastic cord only the ability to hit the ball is developed and correctness of stroke is not indicated.

A still further type of tennis practice apparatus is that described in U.S. Pat. No. 3,231,271. The apparatus comprises various positioning means to indicate correct placement of the feet and racket prior to and after the stroke and a racket type instrument, having no strings and a break in the racket rim which allows the racket, on a correct stroke to pass through a set of mounted tennis balls which simulate a moving tennis ball in a succession of position. This device is similar to a captive ball type of apparatus, in that only the ability to hit the ball is tested.

SUMMARY OF THE INVENTION

The apparatus of this invention comprises a ball mounted for rotation in a circular plane and a target path defining means to indicate if the ball is rotating in the desired circular plane.

Another aspect of this invention comprises a racket target means and more preferably a racket target means defining an area slightly larger than a tennis racket face.

In a preferred embodiment of this invention the ball and target path defining means are mounted on and form part of the racket target means.

The apparatus of this invention is constructed and arranged to teach the fundamentals of the tennis stroke and in particular to teach the correct method of executing the forehand, backhand and service strokes while developing the muscles used in executing these strokes.

It is further constructed to provide easy adjustment to permit selective practicing of the aforementioned strokes at different levels simulating normal play.

Additionally, the apparatus of the instant invention provides a quick and accurate method of indication to the user when an incorrect stroke has been executed.

The apparatus is further constructed to make it readily useable for practice indoors or outdoors.

BRIEF DESCRIPTION OF THE DRAWINGS

The present invention may be better understood and its numerous objects and advantages will become apparent to those skilled in the art by reference to the accompanying drawings in which.

DESCRIPTION OF THE PREFERRED EMBODIMENT

Figure 1:
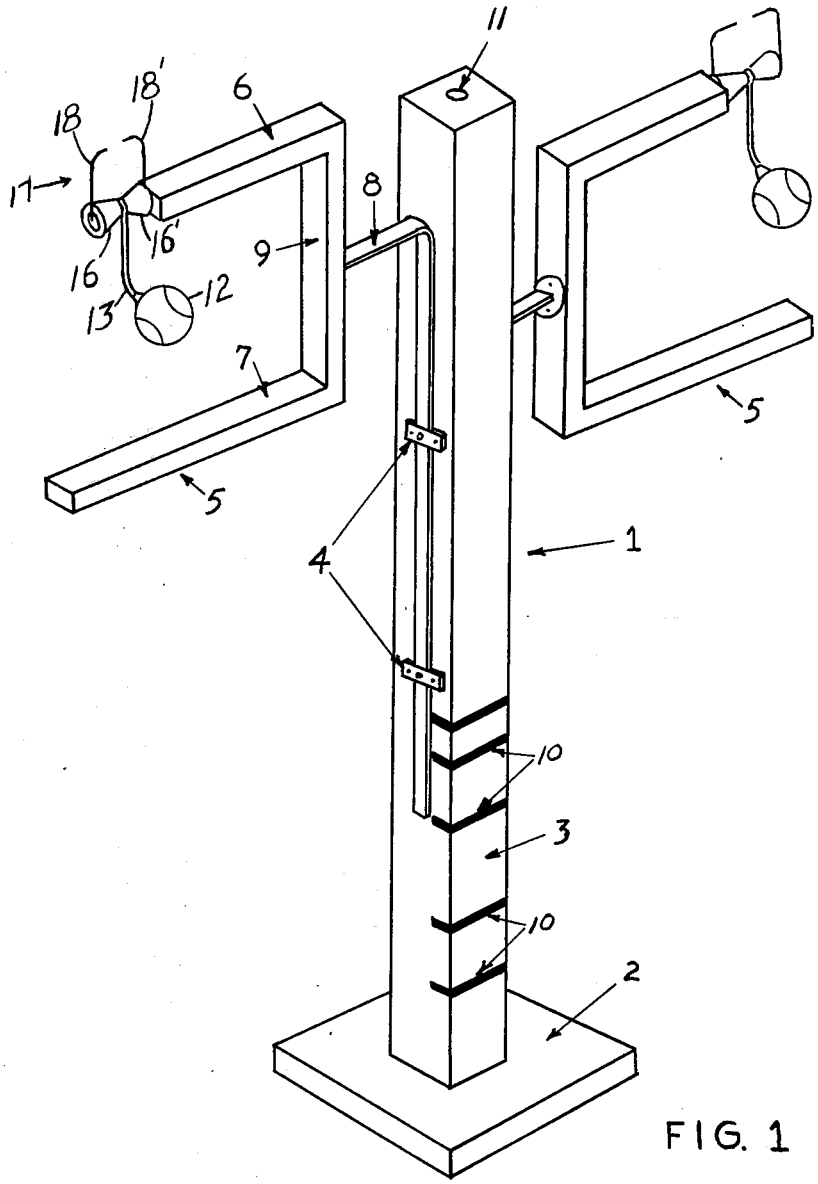
FIG. 1 is a perspective view illustrating one embodiment of the present invention.

With reference to the drawings, the tennis practice device of this invention as illustrated in FIG. 1 comprises a support structure 1 comprising a base member 2 and a shaft 3, such pieces being formed from wood, metal, rigid plastic material, or other suitable material. The base must be sufficiently large and heavy to maintain the apparatus in an upright position in use as will be later described. Alternatively, the base may be large enough to provide for loading with heavy weight objects such as sand bags. In a further embodiment the base may be provided with means for attachment the base may be provided with means for attachment to the ground.

The upright shaft is provided with one or more fastening members 4 into which the racket target members 5 may be adjustably mounted. The racket target members comprise a three-sided or U-shaped frame having an upper leg 6 and a lower leg 7 and a spanning member 9 and preferably made of or covered with a resilient material to prevent damage to a tennis racket if inadvertantly struck on an incorrect stroke. The frame defines an inner area approximating the size of the face of a tennis racket. For the purpose of this application the "face" of the tennis racket is the strung part of the racket and the outside frame: the remainder of the racket will be referred to as the "handle". The two legs of the frame 6 and 7 define an area somewhat wider than the width of a tennis racket face. The distance between the legs may be varied to present a larger target area for the inexperienced player or an area only slightly larger than the racket face for a more experienced player.

The length of the legs may be varied according to the depth of the target area desired to be presented. When used in conjunction with the rotating ball means, to be later described, the entire length of the upper leg with the rotating ball means attached must be at least one-half the height of the racket face. In using the racket target means of this invention the player attempts to execute a stroke whereby the racket will pass through the inner area defined by the target means with the two sides of the frame in a plane with the two legs of the target means without contacting the legs or spanning members of the target means with the racket.

Figure 2:
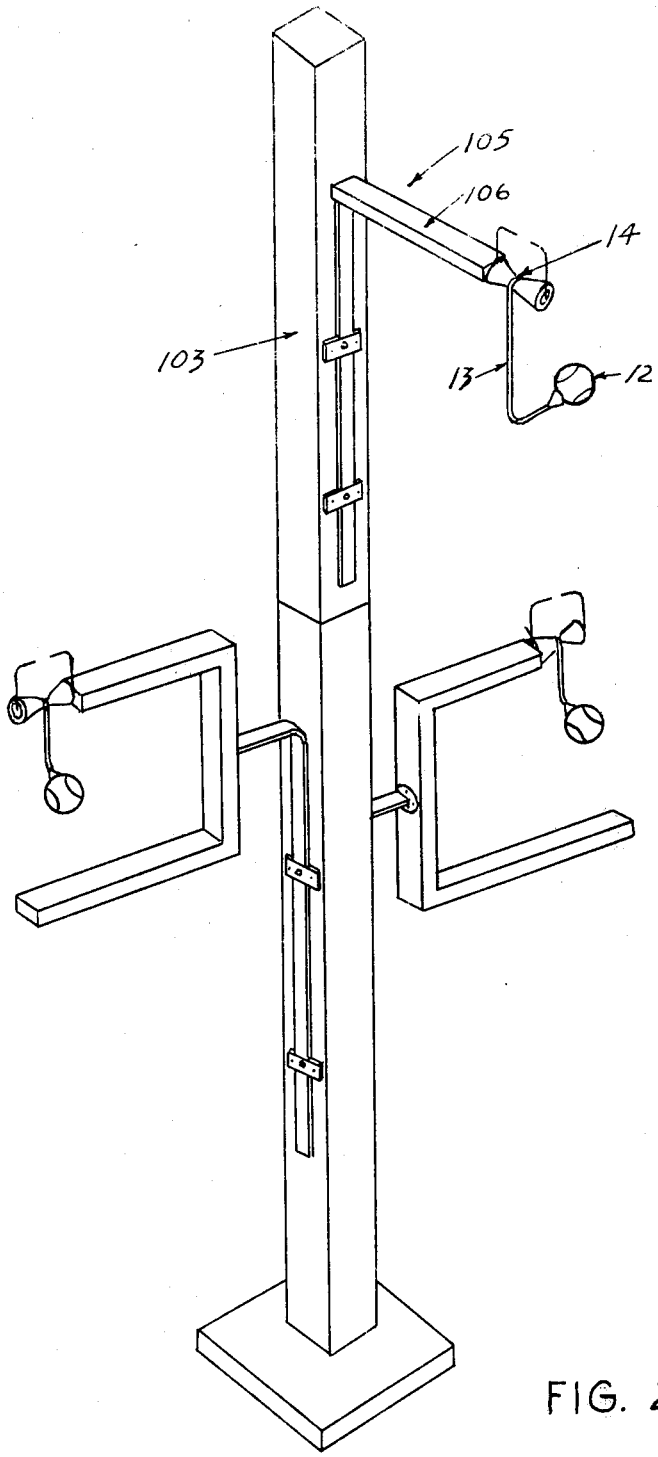
FIG. 2 is a perspective view illustrating a preferred embodiment of this invention.

The racket target means is mounted to the support shaft by means of the rod or bar 8 secured to the spanning member 9 between the legs of the frame and adjustably mounted in the fastening member 4. The height of the racket target means may be adjusted by moving the mounting rod up or down in the fastening member to obtain the desired height for the particular individual and stroke being practiced. Means may be provided for permanently recording the appropriate position for various strokes and/or individuals so that the position may be quickly changed without remeasurement such as by the tape markings at 10. At the top of the upright support shaft means such as a screw hole 11 may be provided for mounting a further apparatus for the practice of additional strokes such as shown in FIG. 2 wherein a supplemental support shaft 103 is mounted on the main shaft 3. Alternatively, the main shaft may be made of a height sufficient to provide for the correct mounting height of a further target member 105 which is adapted for practicing strokes different from those provided by the lower mounted target members. Specifically, the lower target members are utilized to practice the forehand and backhand strokes while the upper target is utilized to practice serve strokes. The manner of utilizing the various aspects of the invention will be more fully described hereinafter.

The further extension of the main shaft is also provided with fastening members 4 into which the serving stroke target member may be adjustably mounted. The serving stroke target members have only an upper leg defining means 106 at the outer end of which the rotating ball means may be mounted. The target member is mounted by means of a rod or bar secured to the end of the leg and positioned in a fastening member 4.

The rotating ball means comprises a ball 12 mounted on a wire 13 which preferably has a resilient covering. The other end of the wire is mounted as by an S-shaped swivel or eye 14 for rotation about the end of the upper leg of the racket target by means as hereinafter described. In the case of the U-shaped target means the ball is suspended at a point half way between the upper and lower legs of the racket target means; in the case of the serve stroke target means the ball is suspended at a distance from the leg at least equal to half the height of the racket face.

Figure 3:
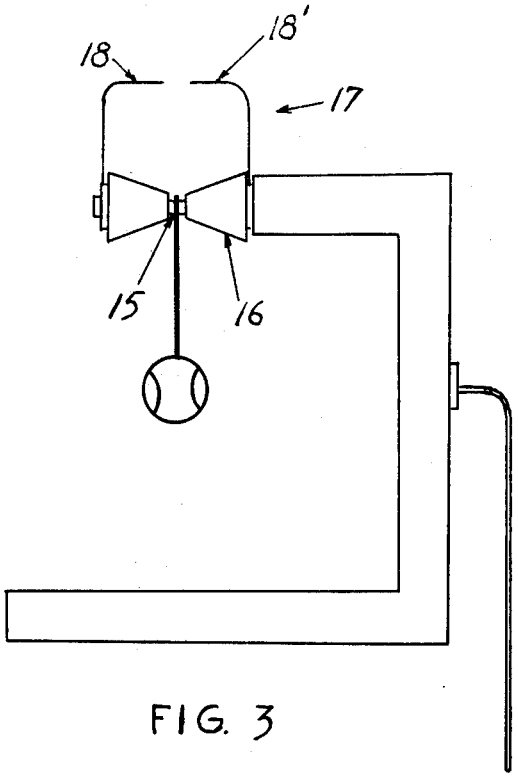
FIG. 3 is an enlarged view showing the ball mounting and correct stroke indicating means and the racket target means of FIG. 2.

As more fully illustrated in FIG. 3 the ball supporting wire is mounted in a circumferential defined by a channel 15. Spacing means 16,16' mounted at the end of the upper leg of the racket target means. The spacing means are preferably cylindrical, conical or similarly shaped pieces of wood, metal, plastic or equivalent material. Mounted from the outsides of the spacing means is the target path defining means 17 for the rotating ball which defines an area through which the wire on which the ball is mounted will pass when the ball is struck correctly causing it to travel in a circular plane perpendicular to the upper leg of the racket target means. If the ball is hit incorrectly, that is, if it is sliced or hit on a diagonal line, it will rotate in a plane on an angle from the perpendicular and will strike the target path defining means rather than passing through the defined path and will return to the original suspended position rather than continue rotating. In the preferred embodiment the target path defining means comprises two arms 18,18' extending generally vertically and inward toward the channel.

Figure 4:
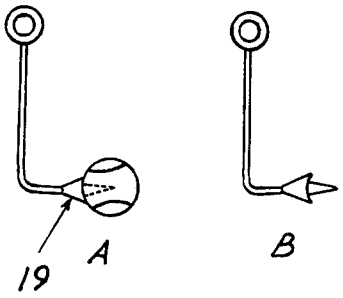
FIG. 4 is a side view of the mounted ball of FIG. 3.

In a further embodiment of this invention the ball is mounted on the wire at a point opposite the point of contact with the racket as shown in FIG. 4. In the most preferred embodiment the wire is provided with an enlargement 19, inward from the end which prevents the ball from being pushed further onto the wire upon impact with the racket and thereby maintains the ball in spaced relationship away from the remainder of the wire.

Figure 5:
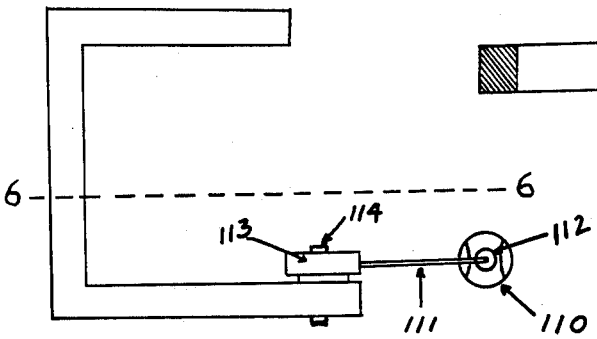
FIG. 5 is a plane view of the racket target means with a captive ball practice device mounted thereto.

FIG. 5 illustrates an additional apparatus which may be mounted on the racket target means to provide a captive ball practice device. This captive ball device comprises a ball 110 mounted on a wire 111 preferably having a resilient covering and an enlargement 112 inward from the ball mounted end which prevents the ball from being pushed further onto the wire on impact.

The wire is mounted for rotation in a plane parallel to the ground as by securing the wire 111 to a block of wood or similar material 113 such that the wire is parallel to the ground and further mounting the block to the end of the lower leg of the racket target means for horizontal rotation about an axis perpendicular to the mounting wire as by a bolt 114 passing through the block and racket target leg and secured by a nut.

Figure 6:
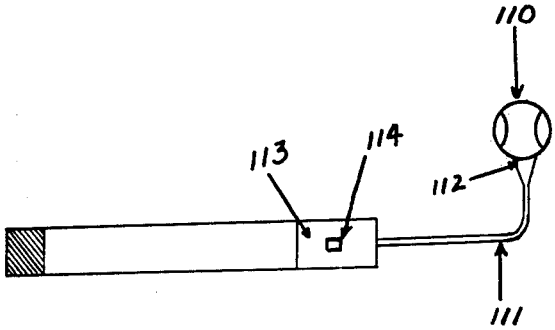
FIG. 6 is a cross-sectional view of the racket target means of FIG. 5 taken along the line 6—6.

FIG. 6 is a cross-sectional view of the racket target means taken along the line 6—6' to more clearly show the mounting position of the ball.

Figure 7:
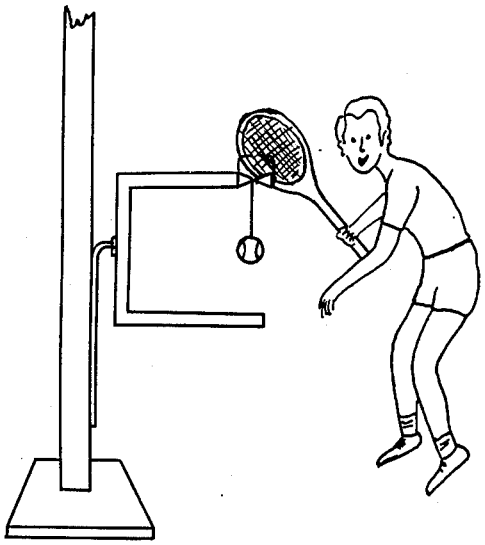
FIG. 7 is an illustration of the apparatus of this invention being used to practice a forehand stroke.
Figure 8:
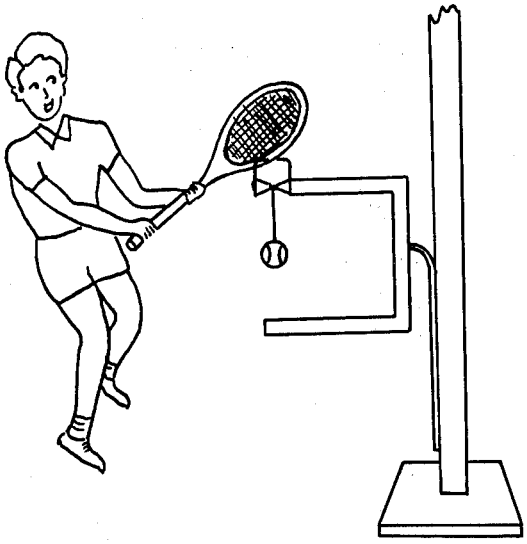
FIG. 8 is an illustration of the apparatus of this invention being used to practice a backhand stroke.

The use of the apparatus of this invention is illustrated by FIGS. 7, 8 and 9. The apparatus provides means for practicing forehand, backhand and service strokes by right-handed or left-handed persons of all heights.

To utilize the racket target means to practice the correct position of the racket on a stroke the racket target means is positioned by the adjustable mounting bracket to define a target area at the point of correct racket position for contact with the ball on the stroke being practised. For the forehand and backhand strokes the practice apparatus is positioned so that the support shaft, with the target member attached thereto is positioned at the same side of the player's body as the oncoming ball to be stroked would be with the racket target means defining the area of racket travel at the desired contact point with the ball, at approximately the waist height of the player. In the practice of a forehand stroke the apparatus would be positioned on the same side of the body as the hand which is holding the racket as in FIG. 7. In the practice of a backhand stroke the apparatus would be positioned on the opposite side of the body from the hand which is holding the racket.

The player then stands at a distance from the racket target means to allow full extension of the arm while the racket is passing through the target means. The player then stands in the correct position preparatory for a stroke and then executes the stroke aiming the racket through the racket target means. On a correctly executed stroke the racket will pass through the area defined by the racket target; on an incorrectly executed stroke the racket will hit one of the legs or the spanning member of the target means, indicating incorrect execution of the stroke.

In the preferred embodiment of this apparatus the racket target means is provided with the rotating ball means hereinbefore described which further indicates the correctness or incorrectness of a stroke on being hit. Specifically, the ball mounting means indicates whether the ball has been hit squarely or whether it has been sliced or hit on a diagonal. When hit correctly the ball will rotate repeatedly in a plane perpendicular to the leg of the racket target means. When hit incorrectly the ball will make a partial rotation, strike one of the target path defining means and will then be returned to its original position.

In the preferred embodiment as shown in FIG. 1 the support shaft is provided with two racket target means each of which is provided with rotating ball means wherein the ball is mounted on the wire at a point opposite the point of contact with the racket such that one of the racket target means is the mirror image of the other. In use, therefore, the first racket target means would be used for practicing the forehand stroke while the second would be utilized for the backhand stroke. Further the target means utilized to practice the forehand stroke by a right-handed player would be utilized to practice a backhand stroke by a left-handed player.

Figure 9A:
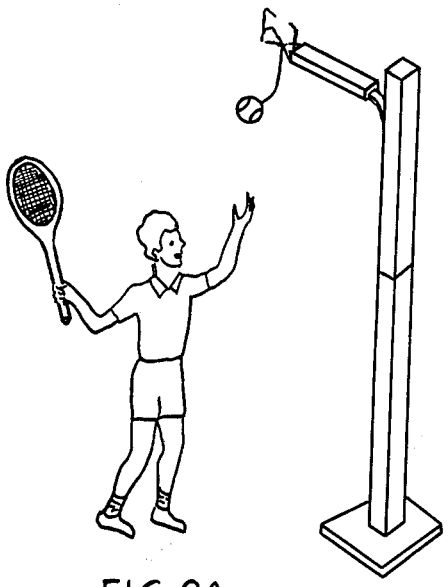
FIGS. 9A and 9B are illustrations of the apparatus of this invention being used to practice a serve stroke.

In the most preferred embodiment the apparatus is provided with two racket means for practicing the forehand and backhand stroke and a third target means for practicing the serve stroke as shown in FIG. 2. When the apparatus is being used to practice the serve stroke it is preferred that the target means for practicing the forehand and backhand be removed as shown in FIG. 9*a.*

Figure 9B:
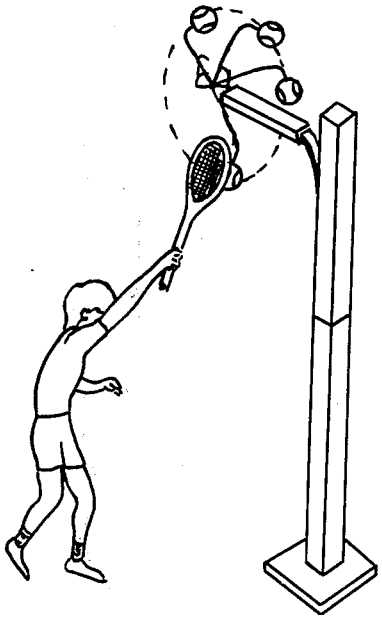

The service stroke target means defines the height the top of a tennis racket is to travel to on the service stroke of the player using the practice apparatus of this invention. As such it defines the target area for a service stroke by defining the upper limit of racket travel. The rotating ball means is mounted from the outer end of the racket target means so as to position the ball at a distance from the racket target means equal to slightly more than one-half the width of the racket face. In such a position with the correct execution of a service stroke the racket will pass just under the leg comprising the racket target means and strike the ball mounted at the end of the wire of this rotating ball means with the center of the face of the racket. When the ball is hit squarely with such a stroke, that is, with the racket face in a plane perpendicular to its line of travel, as in the correct method, the ball will rotate in a plane perpendicular to the leg of the racket target means, the wire ball mount passing through the path defining means once on each rotation as shown in FIG. 9*b.*

If the ball is hit incorrectly, that is, with the racket face in a plane or an angle so that it is not perpendicular to the line of travel, the ball will begin to rotate in a plane on an angle from the perpendicular above described and the mounting wire will strike one side of the path defining means and return the ball to the original position indicating incorrect execution of the stroke.

The captive ball apparatus which may be provided as an additional apparatus to this invention is utilized by mounting on the upper leg of the racket target means for forehand or backhand strokes. It is mounted to allow rotation about the mounting point. To use, the racket target means is adjustably positioned the shaft to place the lower leg and captive ball means at the desired position of an oncoming ball in play. The player then positions himself at a sufficient distance from the mounted ball so that his arm holding the racket will be fully extended as the center of the racket meets the ball on a stroke. When hit the ball will rotate in a plane around the mounting point and may be stopped and repositioned for another stroke with the hand or racket.

In a further embodiment of the apparatus markers may be provided to be placed on the ground around the support shaft indicating the correct placement of a player's feet while in preparation for the stroke, during the execution of the stroke and upon completion of the stroke. Alternatively, a plan or mat may be provided to be placed on the ground under or around the support shaft bearing indications of the foot positions for executing each of the forehand, backhand and service strokes either separately or in combination.

In addition to indicating when a correct or incorrect stroke has been executed the apparatus of this invention is useful in preventing the injury which, while not incurred solely in playing tennis, is commonly termed "tennis elbow". The injury is caused by impact and strain to the elbow joint which results when hitting an object and subjecting the limb holding the racket (or other piece of equipment) to tension and shock while in a skewed position offering little or no natural cushioning of the impact.

The apparatus herein is useful in preventing tennis elbow in that it guides the player in developing the correct method of stroke a ball therein avoiding hitting the ball with the arm in a skewed position. It further prevents tennis elbows by developing the arm muscles thereby allowing them to withstand greater shock if the ball is hit with the arm in a skewed position.

The invention has been described with particular reference to the sport of tennis but is equally applicable to the sports of baseball, paddle ball, pingpong, and any other sport in which a ball is hit while in mid-air.

What is claimed is:

1. An apparatus for practicing strokes comprising:

a substantially vertical upstanding support member having a base;

a substantially horizontal second support member; means adjustably mounting said second support member to said upstanding first member adjacent the upper end thereof;

an elongated wire;

said wire having means rotatably attaching one of its ends to said second support member adjacent the outer free end thereof, such that said wire is rotatable about the longitudinal axis of said second support member in a vertical plane;

a ball;

said ball being mounted on the other end of said wire and being suspended below said second support member whereby being struck on the exercise of a stroke will cause said ball and wire to travel in said vertical plane around the longitudinal axis of said second support member;

a guide member;

said guide member being a pair of elongated resilient arms, each of said arms being attached to said second support member and extending substantially vertically upwards therefrom, one of said arms being positioned on one side of said vertical plane of travel of said ball and wire and the other arm being positioned on the opposite side of said second vertical plane of travel of said ball and wire, the upper end of each of said arms being bent towards said second vertical plane of travel to define a path through which said wire may pass when said ball is struck, whereby when said ball is hit correctly said wire will travel through said path without touching said arms and if said ball is hit incorrectly at least one of said arms will be touched by said wire.

2. The apparatus the claim 1 wherein said ball is mounted on said wire by attachment at a point on the ball surface opposite the point of contact when the ball is struck in the exercise of a stroke.

3. The apparatus of claim 2 wherein said mounting wire bears an enlargement at the ball mounted end to limit the movement of the ball on the wire.

4. The apparatus of claim 1 wherein said upstanding support member bears indicia for indicating positions of the adjustably mounted second support member.

* * * * *